US005681115A

United States Patent [19]

Diederich et al.

[11] Patent Number: 5,681,115

[45] Date of Patent: Oct. 28, 1997

[54] CHILD-RESISTANT LOCKING DEVICE FOR RECLOSABLE BAG

[76] Inventors: R. David Diederich, 12 Little Brook Dr., Pittsford, N.Y. 14534; Ray G. Brooks; Tim W. Brooks, both of 2505 Custer Ct., Irving, Tex. 75062

[21] Appl. No.: 582,559

[22] Filed: Jan. 2, 1996

[51] Int. Cl.[6] ..... B65D 33/24

[52] U.S. Cl. ..... 383/64; 190/120; 190/903; 383/5; 383/97

[58] Field of Search ..... 24/387; 383/5, 383/64, 97; 190/903, 120; 70/68

[56] References Cited

U.S. PATENT DOCUMENTS

| | | | |
|---|---|---|---|
| 1,585,644 | 5/1926 | Binns et al. . | |
| 1,903,415 | 4/1933 | Greenberg . | |
| 2,256,680 | 9/1941 | Lemmer | 24/205.5 |
| 2,310,627 | 2/1943 | Greene | 383/97 |
| 2,383,197 | 8/1945 | Johnson | 24/205.5 |
| 2,569,076 | 9/1951 | Schaye | 24/387 |
| 2,826,797 | 3/1958 | Reeves et al. | 24/387 |
| 2,942,450 | 6/1960 | Krug | 24/387 |
| 3,335,586 | 8/1967 | Levine et al. | 70/68 |
| 3,759,073 | 9/1973 | Rifkin | 24/387 |
| 3,852,851 | 12/1974 | Higuchi et al. | 24/387 |
| 3,899,804 | 8/1975 | Kawashima | 24/205.15 R |
| 3,971,458 | 7/1976 | Koenig | 24/387 |
| 3,991,444 | 11/1976 | Bailey | 24/16 PB |
| 4,112,990 | 9/1978 | Anderson | 383/97 |
| 4,236,280 | 12/1980 | Kreiseder | 24/16 PB |
| 4,494,592 | 1/1985 | Bonner | 383/97 |
| 4,598,826 | 7/1986 | Shinbach | 383/200 |
| 4,602,405 | 7/1986 | Sturman et al. | 383/5 |
| 4,661,990 | 4/1987 | Rifkin | 383/5 |
| 4,688,302 | 8/1987 | Caveney et al. | 24/16 PB |
| 4,815,176 | 3/1989 | Yoshida | 24/387 |
| 4,890,935 | 1/1990 | Ausnit et al. | 383/64 |
| 4,930,323 | 6/1990 | Terada et al. | 70/68 |
| 5,081,855 | 1/1992 | Terada et al. | 70/68 |
| 5,136,758 | 8/1992 | Wilcox et al. | 24/431 |
| 5,195,221 | 3/1993 | Kanamaru et al. | 24/429 |
| 5,199,795 | 4/1993 | Russo et al. | 383/113 |

*Primary Examiner*—Stephen P. Garbe
*Attorney, Agent, or Firm*—Geoffrey A. Mantooth

[57] ABSTRACT

A child-resistant locking device for a flexible bag, pouch or the like having an opening and requiring child-resistant packaging which is to be filled with hazardous articles including a zipper operatively associated with the opening and movable between an open and closed position, the zipper being provided with a pull tab having an opening for actuating the zipper and a releasable lock supported on the bag operatively associated with the pull tab opening for releasably retaining the zipper in the closed position with the lock including elements requiring manual dexterity with both hands at a skill level common to an adult as opposed to a child for release.

14 Claims, 6 Drawing Sheets

CHILD-RESISTANT LOCKING DEVICE FOR RECLOSABLE BAG

FIELD OF THE INVENTION

This invention relates to a releasable locking closure for a flexible bag or pouch adapted to contain hazardous material or any product requiring resistance to entry of a package by a child and more particularly to a zipper-type closure for such a bag which requires the manual dexterity of an adult exceeding that of a child for opening and closing the bag.

DESCRIPTION OF THE PRIOR ART

The packaging of certain materials commonly referred to as "hazardous or toxic materials" and other products such as pharmaceuticals that require child-resistant packaging have always posed certain problems where such materials are accessible to children. Such toxic materials commonly found in the home or farm as well as the surrounding areas usually include such materials as cleaners, fertilizers, insecticides, pharmaceuticals and the like which are now packaged in rigid containers, bottles, non-reusable bags and cans. With respect to children, problems arises when the container may be only used partially from time-to-time requiring that the packaging be opened and closed frequently before the contents are exhausted. Therefore, under these conditions, the storage of such materials in locations such as homes, garden sheds, farm buildings and the like which are frequented by young children presents a situation of potential risk to such children.

The natural inquisitiveness of children propels them to become exposed to and even to ingest such materials when available and even when such materials are stored in suitable containers, access to the contents of such containers can often be accomplished rather easily by a child. The ease of such access is magnified when the containers have been opened for partial use of the contents and then resealed.

Partial relief of the danger to children in such cases has been obtained by the provision of zippered bags which permit the bag to be readily resealed after partial use. However, zippers are relatively easy to manipulate and even relatively young children find it easy to operate a zipper thereby gaining access to the bag interior and the contents therein.

Some success has been achieved in retaining such zippers in the closed position while permitting easy manipulation of the zipper by an adult. For instance, in U.S. Pat. No. 3,335,586-Levine et al a key-operated lock is provided on the zipper which holds the slider in the closed position. Obviously, this arrangement has the disadvantage of requiring a key which would pose considerable inconvenience and, in addition, frustration if the key is not available. In other patents such as U.S. Pat. No. 3,889,804-Kawashima and U.S. Pat. No. 2,256,680-Lemmer clamping members are used to retain the zipper in the closed position but these arrangements would be easily overcome by a child who would need only to lift up the pull tab for unlocking.

SUMMARY OF THE INVENTION

Accordingly, a primary object of this invention is to provide a new and novel releasable locking closure for a flexible bag or pouch of the type used for materials or articles such as weapons requiring child-resistant packaging.

Another object of the invention is to provide a new and novel zipper lock for a bag which may be easily released by an adult but which resists the actuating efforts of even the most clever child.

Another object of the invention is to provide a new and novel child-resistant zipper lock for a flexible bag which requires the use of both hands of the user for opening and closing the bag.

Still another object of the invention is to provide a new and novel releasable zipper lock which is simple and inexpensive in construction, which may be easily installed without zipper modification and which is capable of prolonged use without breakdown.

A still further object of the invention is to provide a new and novel child-resistant zipper lock for a flexible bag which may be formed in a plurality of embodiments, all of which use a conventional metal zipper slider and pull tab without modification.

Still another object of the invention is to provide a new and novel child-resistant zipper closure for a flexible bag which requires two separate and distinct unlocking steps at least one of which requires the use of both hands.

A still further object of the invention is to provide a new and novel child-resistant zipper closure for a flexible bag in which a plurality of steps for unlocking the closure are required all of which are manual and all of are beyond the manual dexterity of the average child.

The objects stated above and other related objects are accomplished by the provision of a zipper on the opening of of a flexible bag or pouch, the zipper being provided with a pair of overlying fasteners and a metal slider and pull tab. A locking assembly of resilient material is mounted on the bag adjacent the zipper closed position. The locking assembly includes a pair of transversely spaced, arms connected intermediate the ends to a base having a boss to define define forward and rearward extending postions. In the zipper closed position, the pull tab opening receives the boss in snap-fitting engagement and the forward portions of the arms also yieldingly retain the zipper slider in the locked position. For unlocking, the pull tab is disengaged from the boss and with one hand, the rearward portions of the arms are squeezed to disengage the forward portions of the arms from the slider and permit movement of the slider with the other hand on the pull tab to the zipper open position.

In another embodiment, the locking assembly includes a pair of transversely extending, upstanding spring fingers of resilient material having lateral notches preferably formed integrally with the upper fastener and positioned adjacent the zipper closed position. The fingers are received within the pull tab opening in releasable locking engagement therewith. For opening the zipper, the spring fingers are squeezed together with one hand for disengaging the fingers from the pull tab and with the other hand on the released pull tab, the zipper may then be moved to the open position.

DESCRIPTION OF THE PREFERRED EMBODIMENTS

Figure 1:
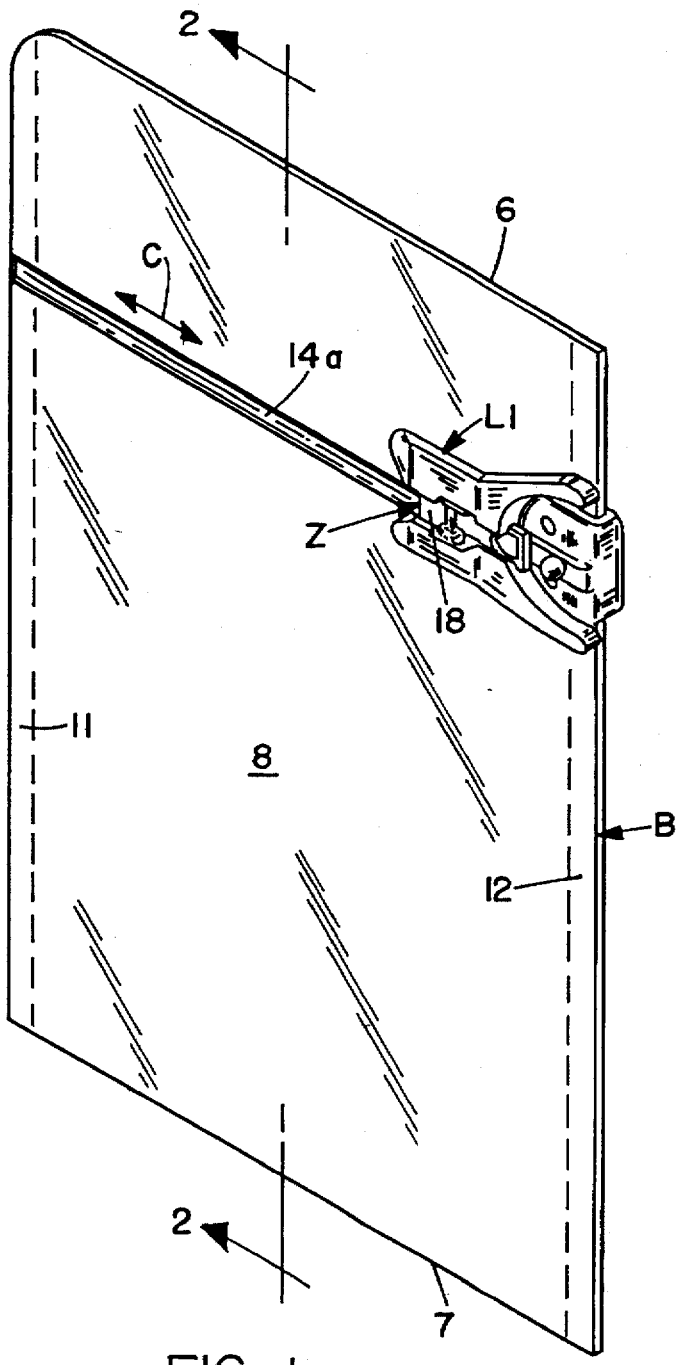
FIG. 1 is a perspective view of a bag incorporating one embodiment of the locking closure of the invention.
Figure 2:
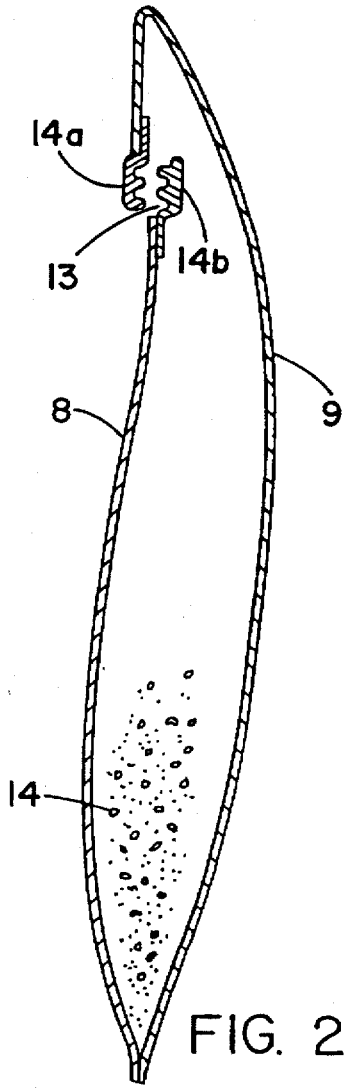
FIG. 2 is a sectional view taken substantially along line 2—2 of FIG. 1.

Referring now to the drawings and to FIGS. 1–7 in particular, there is shown one embodiment of the locking assembly of the invention. As shown best in FIG. 1, this embodiment includes a container such as a flexible bag B formed of a suitable moisture impervious laminated material. Preferably, the bag B is of synthetic resinous material formed from a plurality of laminates including a laminate of VALERON and foil. Additionally, the bag B is also puncture resistant and may be formed from a pair of sheets 8, 9 heat-sealed together along the side edges 11, 12 and having closed top and bottom edges 6, 7.

As is well known, the bag B includes a transverse opening 13 in one wall 8, the opening 13 being adapted to be closed by a zipper of conventional construction which is designated generally by the letter Z. In the illustrated embodiments, the bag B is preferably of the type to be filled with hazardous material designated generally in FIG. 2 by the letter H. Such material H may be an insecticide, pesticide, fertilizer, pharmaceutical or the like which can be injurious to children and animals who must therefore be protected from contact therewith.

The zipper Z includes a pair of complementary fasteners such as upper fastener 14*a* and a lower fastener 14*b* which are mounted by heat sealing or the like on the edges of the side wall 8 defining the bag opening 13. As is well known, the fasteners 14*a*, 14*b* which are arranged in overlying relationship, are pressed into engagement and released therefrom by a slider 18 movable in the direction of the double arrow R as shown in FIG. 1. Thus the opening 13 is closed by sliding movement of the slider 18 into the closed position as shown in FIG. 1.

Figure 3:
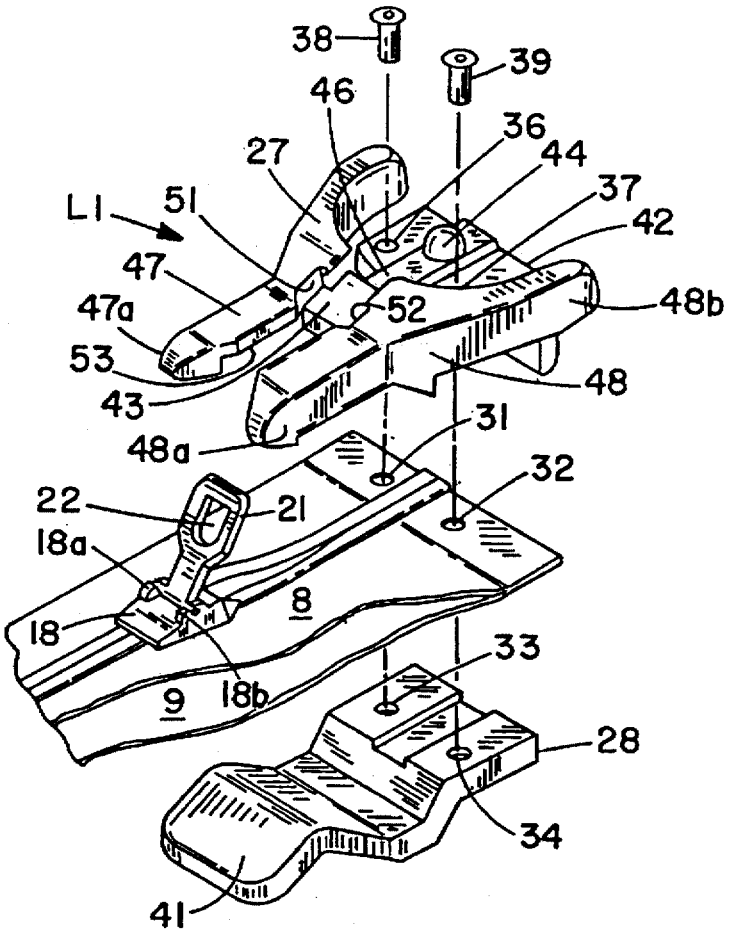
FIG. 3 is an enlarged, exploded view in perspective of of the locking closure of FIG. 1.
Figure 4:
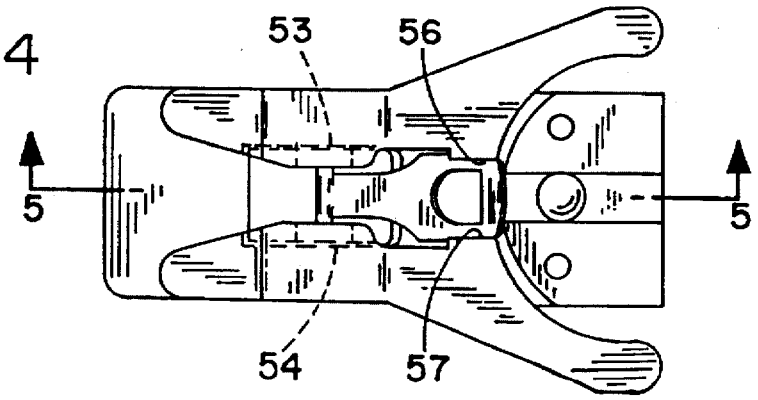
FIG. 4 is a plan view of the locking closure of FIG. 3 with the parts in the locked position.

As shown best in FIG. 3, the slider 18 is of well-known metal construction having a pair of upstanding, spaced-apart ears 18*a*, 18*b* on which is mounted a pivotally movable metal pull tab 21 having a substantially rectangular opening 22. As is well known, the pull tab 21 provides a manual grip to permit sliding movement of the slider 18 along the opening 13 with the user's hand to either open or close the bag B.

Referring now to FIGS. 3–7 in particular, there is shown one embodiment of the zipper locking assembly of the invention designated by the reference L1. In this embodiment, the locking assembly L1 is formed of molded plastic material to provide an upper element 27 and a lower element 28.

Figure 5:
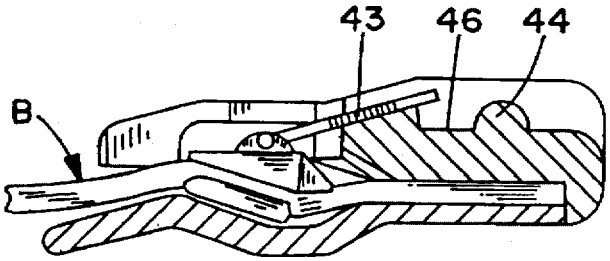
FIG. 5 is a side view partially in section of the locking closure of FIG. 1.

The upper and lower elements 27, 28 are each preferably molded in a one-piece construction and are mounted in overlying relationship as shown in FIG. 5 with the bag B sandwiched therebetween. The elements 27, 28 are secured in an assembled relationship by the provision of a pair of spaced-apart holes 31, 32 in the edge of the bag B, a pair of spaced-apart holes 33, 34 in the lower element 28 and a pair of spaced-apart holes 36, 37 in the upper element 27, all disposed in vertical alignment in the assembled relationship for accommodating a pair of threaded studs 38, 39 respectively.

The lower element 28 includes an inverted, V-shaped portion 41 disposed in underlying relationship with the bag wall 9. The upper element 27 includes a base 42 having a boss 43 and a boss 44 disposed in longitudinally spaced relationship to define a well 46. The upper element 27 also includes a pair of transversely spaced arms 47, 48 integrally connected intermediate the ends at pivot points 51, 52 respectively to the base 42 for limited pivotal movement. The arms 47, 48 include a forward portion 47*a*, 48*a* and a rear portion 47*b*, 48*b* respectively, forward portions 47*a*, 48*a* being provided with undercut notches 53, 54 on one side of the pivot points 51, 52 respectively. On the other side of the pivot points 51, 52, the rear portions 47*b*, 48*b* are provided with flat faces 56, 57 respectively.

Figure 6:
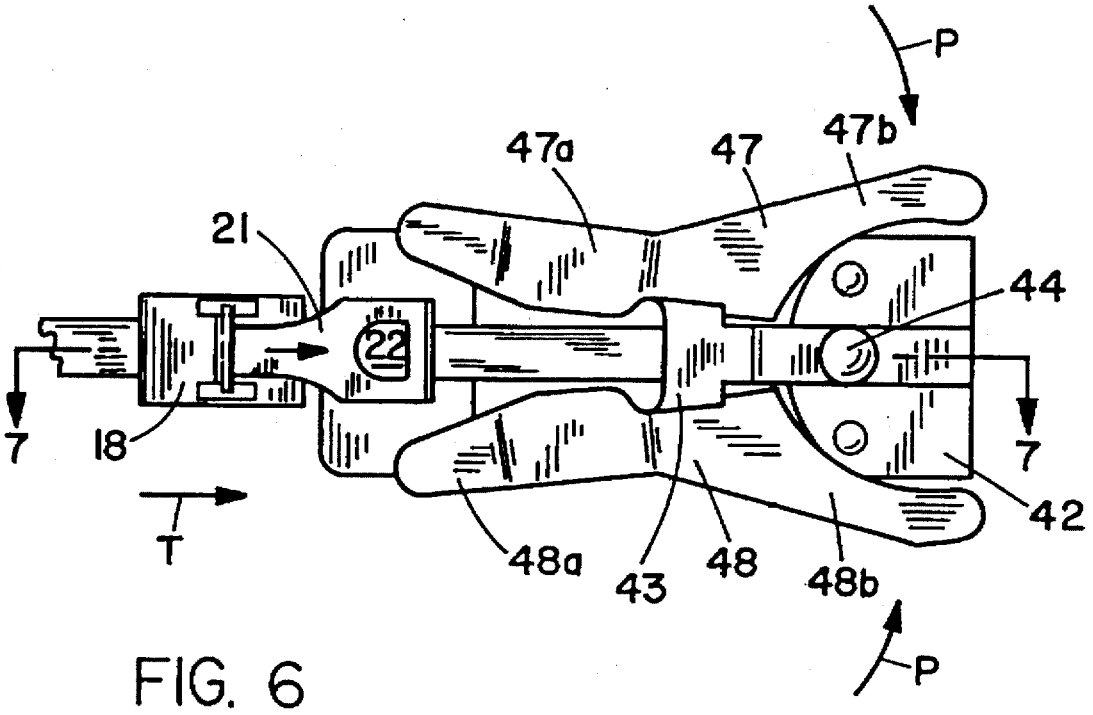
FIG. 6 is a plan view similar to FIG. 4 with the parts in the unlocked position.
Figure 7:
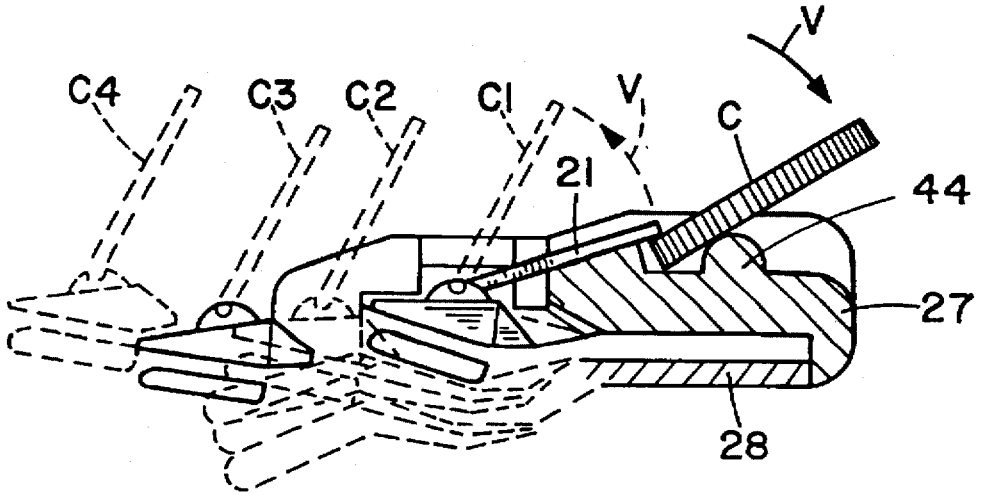
FIG. 7 is a view similar to FIG. 5 showing the unlocking steps for the locking closure of FIG. 1.

To perform the locking operation for the zipper Z, the rear portions 47*b*, 48*b* of the arms 47, 48 are squeezed together manually with one hand as indicated by the arrows P in FIG. 6 and the slider 18 moved in the direction of the arrow T by means of the pull tab 21 as also shown best in FIG. 6. When the slider 18 has been moved to the position of FIG. 4, the arms 47, 48 are released permitting the sides of the slider 18 to be received within the notches 53, 54 and retained therein. Subsequently, the pull tab 21 is pivoted downwardly for snap-fitting engagement of the pull tab opening 22 with the forward boss 43. At the same time, the faces 56, 57 on the rear portions 47*b*, 48*b* of the arms 47, 48 yieldingly engage the adjacent side edges of the pull tab 21 in a retaining relationship as shown best in FIG. 4. Thus, the child-resistant closure is locked to defeat any efforts of a child to open the bag B.

In the closure unlocking operation and referring now to FIG. 5, the first step is to release the pull tab 21 from locking engagement with the forward boss 43. For a child, this would be difficult as it requires the insertion of a suitable tool such as the edge of a coin C in the well 46 between the bosses 43, 44 underneath the edge of the pull tab 21. Pivoting the coin C in the direction of the arrow V using the rear boss 44 as a fulcrum, pivots the pull tab upwardly in the direction of the arrow U thus releasing the pull tab 21 from engagement with the forward boss 43.

As the slider 18 is still retained by the arms 47, 48, the portions 47*b*, 48*b* of the arms must be squeezed again with one hand releasing the slider 18 for sliding movement with the other hand through the various broken-line positions of the pull tab 21 indicated by the arrows C1–C4. This use of both hands for opening the bag B constitutes a further challenge to any attempts by children to gain access to the materials in the bag B.

Figure 9:
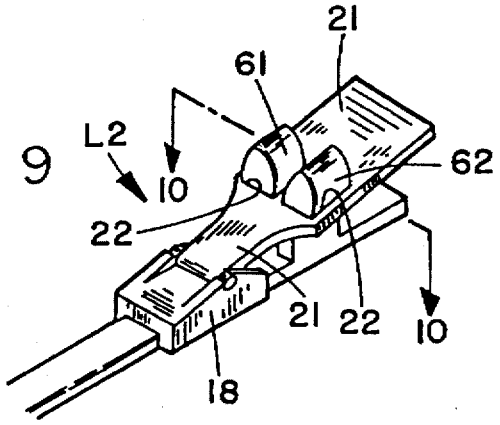
FIG. 9 is an enlarged perspective view of the locking closure incorporated in the bag of FIG. 8.
Figure 8:
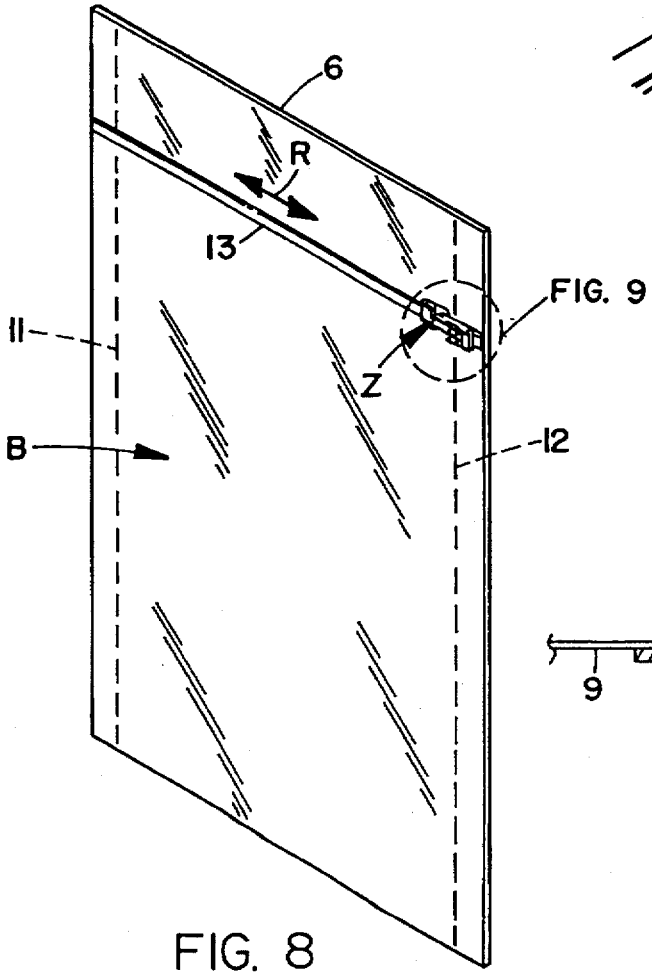
FIG. 8 is a perspective view of a bag similar to FIG. 1 incorporating a second embodiment of the invention.
Figure 10:
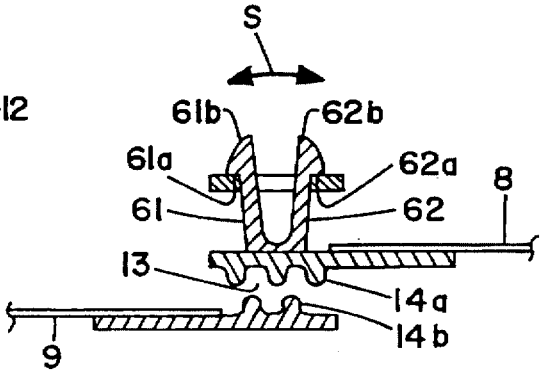
FIG. 10 is a sectional view taken substantially along line 10—10 of FIG. 9.

Referring now to FIGS. 8–10, there is shown a second embodiment of the invention identified as L2 wherein like numerals are used to identify like parts. FIG. 8 shows a bag B of similar construction having heat-sealed edges 11, 12, an opening 13 and a zipper Z including fasteners 14*a*, 14*b* preferably heat-sealed to the adjacent edges of the bag B forming the opening 13. The zipper Z also includes a slider 18 with a pull tab 21 having an opening 22.

The locking closure of FIGS. 8–10 also includes means engageable with the pull tab 21 for locking the slider 18 in the closed position. More specifically, as shown best in FIGS. 9, 10, a pair of upwardly extending, laterally spaced flexible spring fingers 61, 62 having oppositely directed notches 61*a*, 62*a* and camming surfaces 61*b*, 62*b* respectively. These fingers 61, 62 are preferably integrally formed with the upper fastener 14*a* and are yieldingly movable laterally as indicated by the double arrow S. In the operation of the locking closure L2, the zipper slider 18 is moved in the direction of the arrow R (to the right as viewed in FIG. 8) using the pull tab 21 into the closed position of FIG. 8 to close the bag opening 13 after packaging or after partial use of the materials within the bag B. The pull tab 21 is then pivoted downwardly in the direction of the arrow A in FIG. 9 over the camming surfaces 61*b*, 62*b* permitting the fingers 61, 62 to flex and yieldingly enter the pull tab opening 22. As the pull tab is moved further downwardly, the spring fingers yieldingly flex inwardly and the edges of the pull tab opening 22 slide over the camming surfaces 61*b*, 62*b*. When the pull tab 21 is moved past the camming surfaces 61*b*, 62*b*, the fingers 61, 62 are released to move laterally outward for locking engagement of the pull tab with the notches 61*a*, 62*a* as shown in FIG. 10. Thus, the zipper Z is releasably locked in the closed position of FIG. 8 presenting a serious obstacle to any efforts by a child attempting to open the bag.

As in the previous embodiment, the child-resistant feature of the invention is readily apparent in the embodiment of FIGS. 8–10. To release the zipper Z from the locked position it is necessary, using both hands, to squeeze the spring fingers 61, 62 together with one hand to permit the edges defining the pull tab opening 22 to clear the notches 61*a*, 62*a*. At the same time, with the other hand, the pull tab 21 is lifted upwardly withdrawing the spring fingers 61, 62 from the pull tab opening 22 so that simultaneous use of both hands is required.

Thus, the pull tab 21 is free to be grasped for moving the zipper Z from the closed position to the open position. However, such manual dexterity which being relatively simple for an adult, is at a skill level far above that of the typical child who attempts to unlock and open the bag B.

Figure 11:
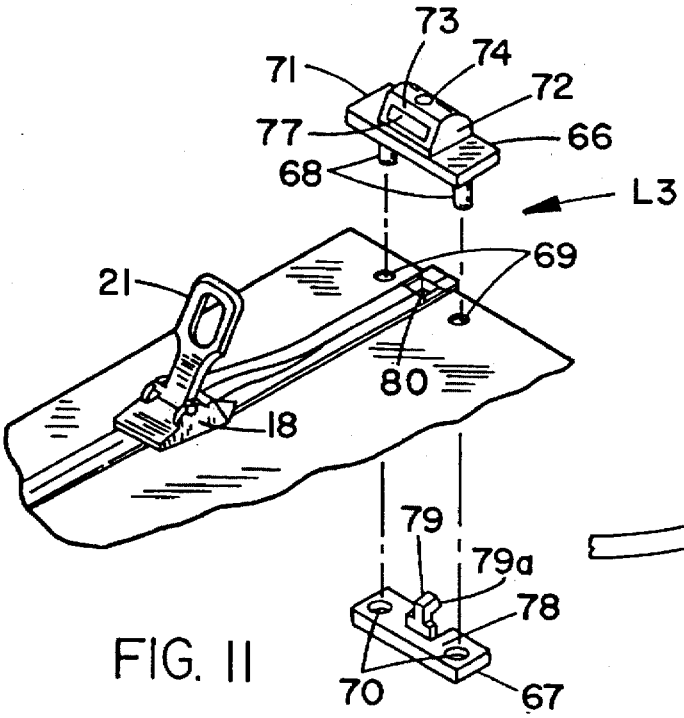
FIG. 11 is an exploded view of a third embodiment of the locking closure of the invention.
Figure 12:
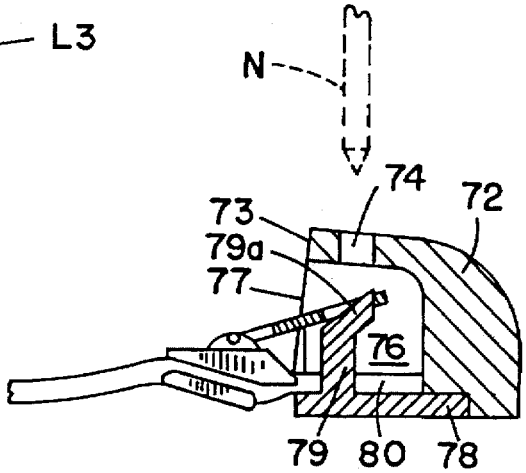
FIG. 12 is an enlarged sectional view of the looking closure of FIG. 11 with the parts shown during a locking step.

Referring now to FIGS. 11–14, there is shown a third embodiment of the locking assembly of the invention wherein like numerals are used to identify like parts. As shown in FIG. 11, the locking assembly designated generally by the reference L3 includes upper and lower elements 66, 67 respectively and is preferably molded of plastic material. As in the previous embodiments, the locking assembly L3 is mounted on the bag B adjacent the zipper closing position.

More specifically, a pair of spaced-apart, downwardly depending pins 68 are formed integrally on the upper element 66 which extend through suitably spaced holes 69 in the bag B for insertion into correspondingly spaced sockets 70 in the lower element 67 to secure the assembly L3 on the bag B adjacent the zipper closing position as shown in FIG. 11.

The upper element 66 includes a base 71 with a housing 72 thereon, the housing 72 including an overhang 73 provided with a hole 74 defining an interior 76 having an opening 77.

The lower element 67 includes a base 78 on which is integrally formed an upstanding member 79 having a L-shaped configuration. In the assembled condition of the locking assembly L3, the member 79 extends through an opening 80 in the bag and into the interior 76 of the housing 72.

Figure 13:
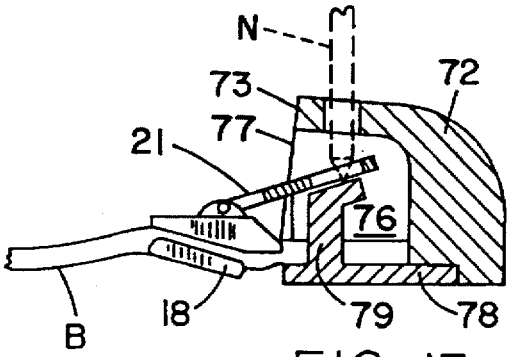
FIG. 13 is a view similar to FIG. 12 with the parts shown during an unlocking operation.

In the zipper closing position, the slider 18 is moved to the right as viewed in FIG. 11 until the pull tag 21 enters the housing interior 76. The upper end 79*a* of the L-shaped member 79 enters the pull tab opening 22 to retain the zipper Z in the bag closing position of FIG. 12. When it is desired to open the bag B, an elongated object such as a pencil N is inserted through the housing opening 74 so as to engage the upper end 79*a* of the member 79 and force the upper end downwardly out of engagement with the opening 22 in the pull tab 21 as shown in FIG. 13. At this time, the released pull tab 21 may be used to move the slider 18 to the left as viewed in FIG. 11 to open the bag.

Figure 14:
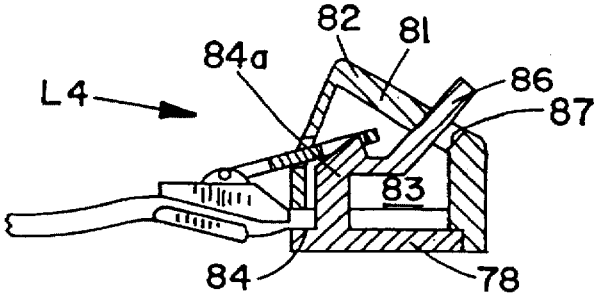
FIG. 14 is a sectional view of a fourth embodiment of the locking closure of the invention.

Referring now to FIG. 14, there is shown a fourth embodiment of the locking assembly of the invention designated generally by the reference numeral L4. The embodiment L4 is a slight modification of the locking assembly L3 and like reference numerals are used to identify like parts. As shown in FIG. 14, the locking assembly L4 includes a housing 81 having a wall 82 defining an interior 83. The base 78 of the lower element 67 is provided with an upstanding, L-shaped extension 84 disposed within the housing interior 83 and having a ridge 84*a* and an arm 86. As shown in FIG. 14, the arm 86 extends through a hole 87 in the housing wall 82. The arm 86 is resiliently urged against the upper wall portion of the hole 87. In the closing position of the zipper Z, the pull tab opening 22 receives the ridge 84*a* to retain the zipper in the closing position of FIG. 14.

To release the zipper Z for opening the bag B, the arm 86 is manually moved downwardly to withdraw the ridge 84*a* from engagement with the pull tab opening 22 to release the the pull tab 21. The slider 18 may then be moved using the pull tab 21 to the left as viewed in FIG. 14 to open the bag B.

Figure 15:
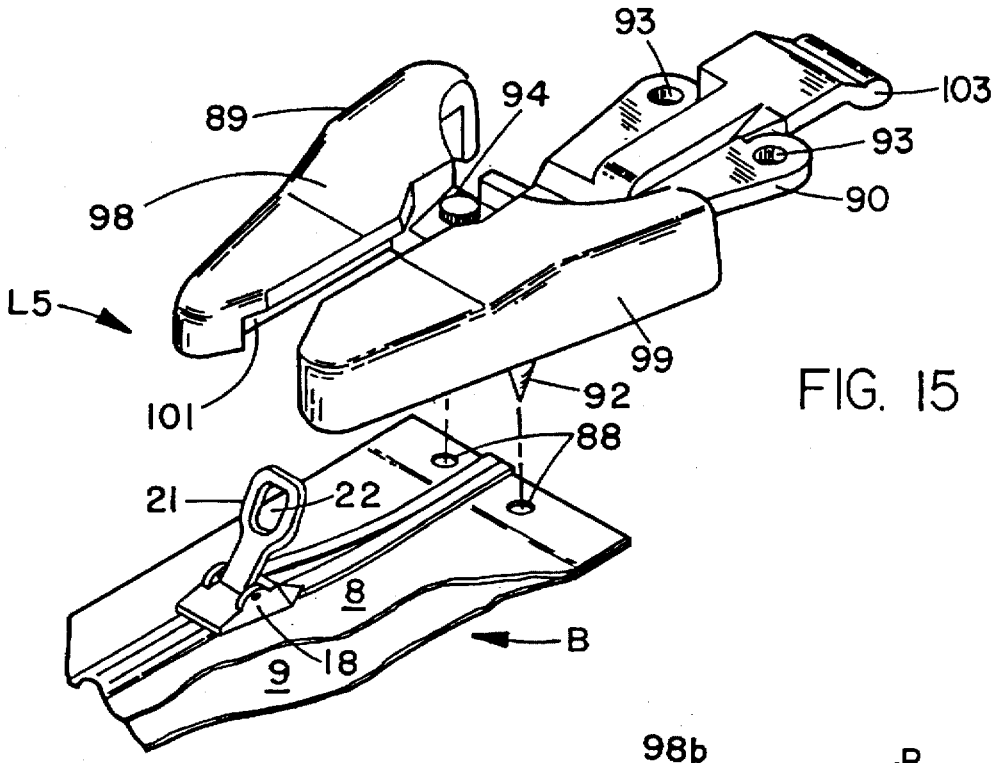
FIG. 15 is a perspective view of a fifth embodiment of the locking closure of the invention.
Figure 16:
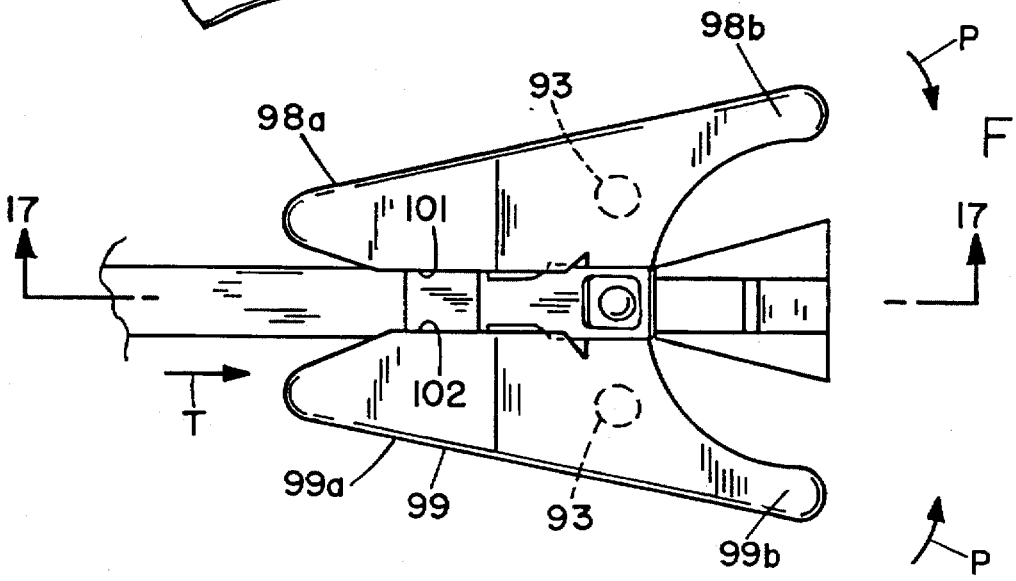
FIG. 16 is a plan view of the embodiment of FIG. 15 shown in the locked, installed position on a bag.
Figure 17:
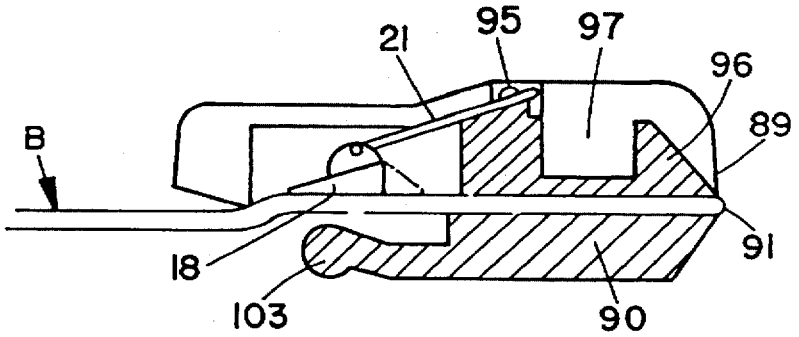
FIG. 17 is a sectional view taken substantially along line 17—17 of FIG. 16.

Referring now to FIGS. 15–17, there is shown another embodiment of the zipper locking assembly of the invention which is designated generally by the reference numeral L5. The locking assembly L5 is similar to that of the locking assembly L1 of FIGS. 3–7 and includes like numerals to indicate like parts.

The locking assembly L5 is mounted on one edge of the bag B adjacent the zipper closing position as shown in FIGS. 15–17. The assembly L5 may be formed in a one-piece molded construction of plastic material and includes upper and lower elements 89, 90 inconnected by a web 91. The locking assembly L5 is securely mounted on the bag B by means of a pair of spaced-apart, downwardly depending prongs 92 on the upper element 89 and a pair of correspondingly spaced holes 93 in the lower element 90. Thus, after proper positioning of the upper element 89 on the bag B, the lower element 90 is folded on the web 91 into underlying relationship with the upper element 89 so that the prongs 92 engage holes 93 through holes 88 in the bag B sandwiched between the upper and lower elements 89, 90 as shown in FIG. 17.

Referring now to FIGS. 15–17, the upper element 89 includes cross-member 94 having a front boss 95 and a rear fulcrum 96 disposed in longitudinally spaced relationship to define a well 97. The upper element 89 also includes a pair of transversely spaced arms 98, 99 integrally connected intermediate the ends to the cross-member 94 for limited pivotal movement. The arms 98, 99 include forward portions 98*a*, 99*a* and rear portions 98*b*, 99*b* respectively, forward portions 98*a*, 99*a* being provided with undercut notches 101, 102 arranged in opposed relationship. It can be seen that the lower element 90 includes an extension 103 formed integrally therewith which is disposed in underlying engagement with the bag wall 9 in the assembled condition of FIG. 17.

To perform the locking operation for the zipper Z, the rear portions 98*b*, 99*b* of the arms 98, 99 are squeezed together manually with one hand as indicated by the arrows P in FIG. 16 and the slider 18 moved in the direction of the arrow T by means of the pull tab 21 as in the L1 embodiment of FIGS. 3–7. When the slider 18 has been moved to the position of FIG. 16, the arms 98, 99 are released permitting the sides of the slider 18 to be received within the notches 101, 102 and retained therein as shown in FIG. 16. Subsequently, the pull tab 21 is pivoted downwardly for snap-fitting engagement of the pull tab opening 22 with the front boss 95. Thus, the child-resistant closure is locked to defeat any efforts of a child to open the bag B. The unlocking operation for the locking assembly L5 is carried out in the same manner as previously described with respect to the closure L1.

We claim:

1. A child resistant container, comprising:

a) a flexible bag having an opening;

b) the opening being closed by a zipper;

c) the zipper having first and second fasteners that are coupled to the bag, the zipper also having a slider moveable between the first and second fasteners, the slider comprising a pull tab;

d) a clamp located adjacent to an end of the zipper, the clamp being coupled to the bag, the clamp receiving at least one portion of the slider so as to retain the slider in a locked position, wherein when the slider is in the locked position, the zipper and the opening are closed, the clamp also allowing the release of the slider to an unlocked position, wherein when the slider is in the unlocked position, the slider can be moved to open the zipper;

e) the clamp having two opposing arms, each arm having first and second ends, the arms being coupled together at a location intermediate the first and second ends, the arms having at least one stop surface located between the first ends and the intermediate location, the anus being moveable between open and closed clamp positions, the stop surface being located between the one portion of the slider and the unlocked slider position when the arms are in the closed clamp position, the stop surface being removed from a location between the one portion of the slider and the unlocked slider position when the arms are in the open clamp position.

2. The container of claim 1, wherein the arms are resiliently retained in the closed clamp position.

3. The container of claim 1 wherein the second ends of the clamp arms form handles that are structured and arranged for squeezing the second ends together.

4. The container of claim 1 wherein the stop surface is formed by a notch in each of the arms, the notch forming a cavity for receiving the slider when the slider is in the locked position.

5. The container of claim 4, wherein:

a) the bag has first and second sides, with the slider located on the first side of the bag;

b) the clamp has first and second elements, with the first element comprising the arms and being located on the first side of the bag, the second element being located on the second side of the bag such that the bag and the locked position of the slider are interposed between the first and second elements;

c) the second element having a ramp that cooperates with the notches in the arms to retain the slider in the locked position.

6. The container of claim 1 wherein the clamp further comprises a boss that is received in an opening of the pull tab.

7. The container of claim 1 wherein:

a) the bag has first and second sides, with the slider located on the first side of the bag;

b) the clamp has first and second elements, with the first element comprising the arms and being located on the first side of the bag, the second element being located on the second side of the bag such that the bag and the locked position of the slider are interposed between the first and second elements;

c) the first and second clamp elements are coupled to each other by way of studs.

8. The container of claim 7 wherein the studs extend through the bag.

9. The container of claim 7, wherein the first and second clamp elements are of a one piece design, coupled together by a flexible webbing.

10. The container of claim 1 wherein the clamp is made of a synthetic resinous material.

11. The container of claim 1 wherein the clamp comprises a mounting member positioned between the intermediate location and the second ends of the arms, each of the arms comprising a projection, with the pull tab being located between the projections and the mounting member when the slider is the locked position.

12. The container of claim 1, wherein:

a) the arms are resiliently retained in the closed clamp position;

b) the second ends of the clamp arms form handles that are structured and arranged for squeezing the second ends together;

c) the stop surface is formed by a notch in each of the arms, the notch forming a cavity for receiving the slider when the slider is in the locked position;

d) the bag has first and second sides, with the slider located on the first side of the bag;

e) the clamp has first and second elements, with the first element comprising the arms and being located on the first side of the bag, the second element being located on the second side of the bag such that the bag and the locked position of the slider are interposed between the first and second elements;

f) the second element having a ramp that cooperates with the notches in the arms to retain the slider in the locked position;

g) the clamp comprises a mounting member positioned between the intermediate location and the second ends of the arms, each of the arms comprising a projection, with the pall tab being located between the projections and the mounting member when the slider is the locked position;

h) the mounting member comprises a second stop surface in the form of a boss that is received by an opening of the pull tab.

13. The container of claim 1 wherein the bag comprises plastic.

14. The container of claim 1 wherein the bag comprises textile material.

* * * * *